United States Patent [19]

Bell et al.

[11] Patent Number: 4,658,646

[45] Date of Patent: Apr. 21, 1987

[54] MAGNETIC ACTUATOR FOR MECHANICAL INDICATOR OF CHANGE OF STATE IN A PRESSURIZEABLE SYSTEM

[75] Inventors: Ross A. Bell; Ernesto M. Abila, both of Sugar Land, Tex.

[73] Assignee: Maloney Pipeline Products Company, Houston, Tex.

[21] Appl. No.: 783,401

[22] Filed: Oct. 3, 1985

[51] Int. Cl.[4] ..... H01H 9/00

[52] U.S. Cl. ..... 73/432.1

[58] Field of Search ..... 73/432 V, 432 A, 3, 73/432.1; 335/205, 207; 200/61.45 R, 61.45 M, 81.9 M; 340/626; 116/204, 267, 275, 273, 281, 282, 284

[56] References Cited

U.S. PATENT DOCUMENTS

| | | | |
|---|---|---|---|
| 2,310,504 | 2/1943 | Aubert | 200/81 |
| 2,419,942 | 5/1947 | Brewer | 200/81.9 M |
| 2,667,631 | 1/1954 | Schuarte | 340/265 |
| 2,892,051 | 6/1959 | Moore | 200/81.9 |
| 3,140,690 | 7/1964 | Siebel | 116/DIG. 42 |
| 3,262,417 | 7/1966 | Zimmer | 116/282 |
| 3,271,708 | 9/1966 | McCormick | 335/205 |
| 3,421,124 | 1/1969 | Kidd | 335/205 |
| 3,478,717 | 11/1969 | Kidd | 335/207 |
| 3,569,648 | 3/1971 | Meyer | 200/81.9 M |
| 4,491,018 | 1/1985 | Stringer et al. | 73/432 |

FOREIGN PATENT DOCUMENTS

| | | | |
|---|---|---|---|
| 624754 | 9/1961 | Italy | 116/281 |
| 761312 | 11/1956 | United Kingdom . | |
| 2076591 | 11/1981 | United Kingdom | 335/207 |

*Primary Examiner*—Stewart J. Levy
*Assistant Examiner*—Robert R. Raevis
*Attorney, Agent, or Firm*—Pahl, Lorusso & Loud

[57] ABSTRACT

A magnetic detector for detecting a change of state in a pipeline, primarily a passage of a marking pig, is disclosed. The actuator has a detector housing and an actuator housing. A piston extends from the detector housing into the pipeline, and is moveable by passage of a pig. A primary permanent magnet coupled to the piston moves in response to the passage of a pig. The actuator housing is adjacent the detector housing and a secondary hammer magnet is located in the actuator housing adjacent the location of the primary magnet in the detector housing. As the primary magnet moves in response to the passage of a pig, the magnetic field produced by the primary magnet moves, interacting with the hammer magnet, which also moves. As the hammer magnet moves, its supporting linkage enters a field generated by a third booster magnet. The booster magnet attracts the hammer magnet and associated linkage toward it. A hammer is connected to the hammer magnet support linkage. As the booster magnet attracts the hammer magnet linkage toward it, the hammer strikes a firing pin, which releases a mechanical flag, thereby signaling passage of a pig, or other change of state in the pipeline.

7 Claims, 7 Drawing Figures

MAGNETIC ACTUATOR FOR MECHANICAL INDICATOR OF CHANGE OF STATE IN A PRESSURIZEABLE SYSTEM

BACKGROUND OF THE INVENTION

This invention relates generally to actuators for mechanical indicators of change of state in a hydraulically or pneumatically isolated system, and more particularly to a magnetic actuator for an indicator detecting a change of state, such as the passage of a pig, in pipelines, pressure containers and the like.

In industrial applications involving chambers or vessels that are isolated hydraulically or pneumatically from the operator's environment, it is often necessary to indicate a change of state in the pressurized or evacuated environment. As an example, in the pipeline industry, typically spherical objects known as "pigs" are introduced into the pipeline to indicate a change of transported fluid, or the end of a transmission or some other change of state. Mechanical detectors are placed in communication with the pipeline so as to be triggered when a pig passes by. Typically, the mechanical detector is in fluid communication with the pipeline itself. Thus, it is necessary to transmit the evidence of the passage of a pig from the internal pressurized environment, outside to the environment of the operator. U.S. Pat. No. 4,491,018, the disclosure of which is incorporated herein by reference, describes generally the use of pig detectors in the pipeline industry.

Several means are used to transmit the evidence of the internal change of state to the outside operator. As one example, the internal mechanical indicator may be attached to a translating shaft which translates, which shaft pierces the container of the pig detector and translates on the outside of the pig detector in some noticeable or measureable way. An obvious drawback of this method is that in piercing the container of the pig detector, the shaft introduces leaks into the system. These leaks must be countered by seals, which often fail, or need to be replaced. Another method, also described in the above referenced patent, involves incorporating a permanent magnet on the translating internal shaft, and detecting a change of magnetic field with a magnetic reed switch attached to the outside of the detector housing in a zone where the magnetic flux will change. A drawback of this method is that an electrical power source must be provided. If the detector is to be used away from permanent power sources, battery sources must be used, which must be continually checked and replaced. Further, the electrical method must be designed to eliminate shorting problems. Finally, this method is prone to failure due to corrosion, which is common in the environments where such detectors are used. Electric devices are also often complicated and expensive to maintain. Finally, if the desired indicator is to be observable visually at great distances, an additional power source must be used to provide mechanical work energy, or the power source powering the electrical device must be suitably sized to deliver the mechanical work energy.

Thus, the several objects of this invention include providing an actuator: that may be used with pressurized or evacuated closed containers without the need for seals or translation of members through a pressure barrier; that does not require provision of an external electric power source; that is resistant to failure due to corrosion; that is resistant to failure due to electrical short circuits; and that is relatively inexpensive to manufacture and maintain. Other objects of the invention will be apparent or will be explained in the following discussion.

SUMMARY OF THE INVENTION

Briefly, this invention utilizes three permanent magnets arranged to trigger a mechanical flag or similar visually perceptible device. A pressurizeable piston housing and an actuator housing are provided. A translating piston is provided in the piston housing, which piston translates in response to a change of state in the pressurized environment, such as the passage of a pig or a change in pressure. A primary permanent magnet is mechanically coupled with this translating piston, so that it translates in response to translation of the piston. There are no mechanical holes or passages from the inside of the piston housing to the actuator housing or outside environment.

A second permanent magnet, a "hammer" magnet, is provided in the actuator housing, normally in a first position, where the interaction of the magnetic fields generated by the primary and hammer magnet produce a force attracting the magnets toward each other. When the first permanent magnet translates in response to the detection of a pig, the magnetic field established by the interaction of the primary permanent magnet and the hammer magnet changes and generates a force repelling the two magnets from each other. The primary magnet is constrained in its motion. The hammer magnet is supported as a pendulum by a swingable pendulum attractor brace and is free to translate in response to the magnetic force. A hammer is mechanically coupled with the hammer magnet so that it moves when the hammer magnet moves in response to the moved primary magnet.

A third permanent magnet, a "booster" magnet, is arranged so that when the hammer magnet moves, the swingable attractor brace, which is made of magnetic material, enters the magnetic field generated by the booster magnet to such a degree as to be drawn further toward the booster magnet. It should be noted that in the absence of translation of the primary magnet, the hammer magnet and swingable brace are not attracted toward the booster magnet to a degree where they move at all. As the swingable brace is drawn toward the booster magnet, the hammer mechanically coupled with the hammer magnet and brace assembly triggers a firing pin which releases a mechanical flag from a spring-loaded rest position to a position detectable by the operator.

Thus, by utilizing the three magnet design, a relatively small magnet may be used as the primary magnet, thereby minimizing the dimensions of the pressurized portion of the detector. Further, it is not necessary for any seals or other mechanical passages to pierce the pressurized container. Finally, the problems associates with an electrical detector, such as providing a power source and preventing against short circuits and corrosion, are not present. If the electrical problems are not critical for a particular application, an electrical triggering system, such as is disclosed in U.S. Pat. No. 4,491,018, may be used in tandem with the wholly mechanical and magnetic system described herein. Such a dual use provides a safeguard against failure of either system, and further permits both local and distant signalling.

DETAILED DESCRIPTION OF THE FIGURES OF THE DRAWING

Figure 1:
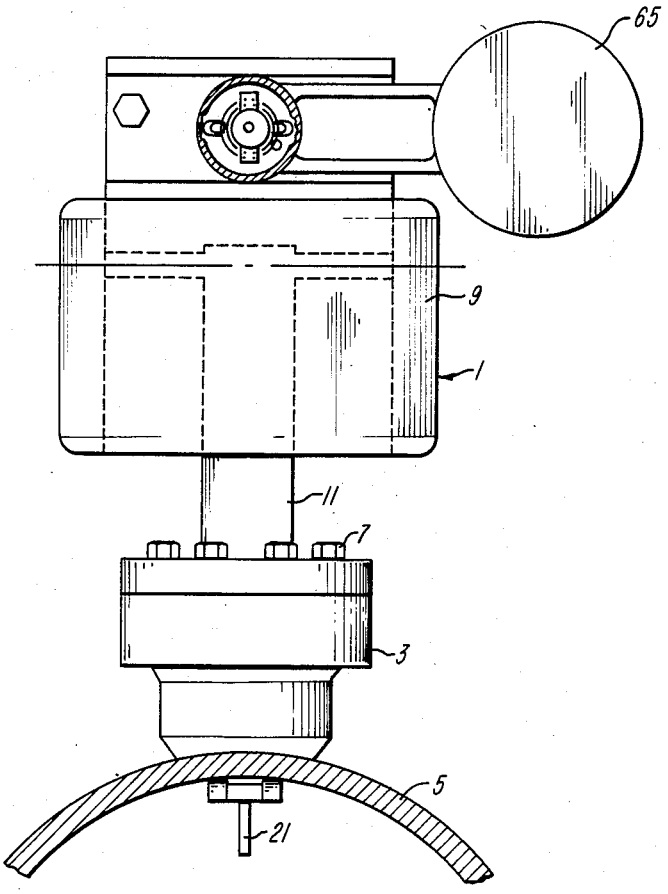
FIG. 1 is a schematic view of a pig detector attached to a pipeline. The flag position indicates the absence of a pig.
Figure 3A:
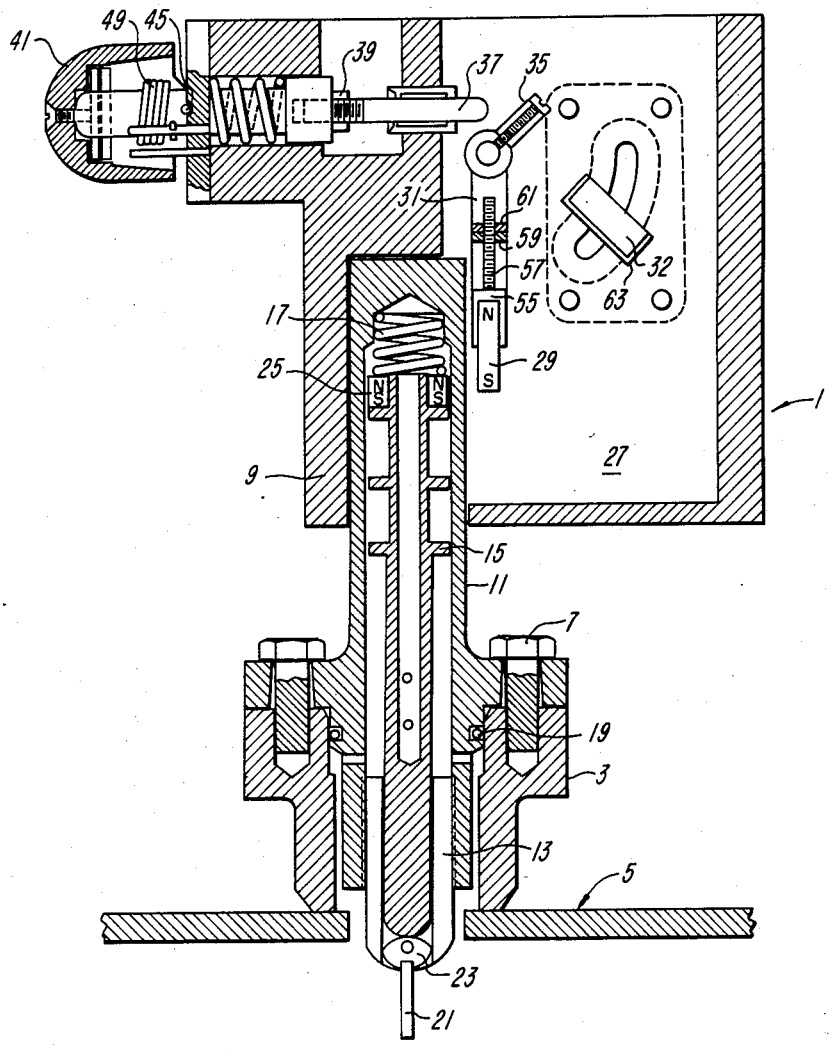
FIG. 3A is a cross-sectional side view of one embodiment of the invention in a state indicating that no pig has passed.

Referring to FIG. 1, a pig detector is indicated generally at 1. The pig detector is mounted on a flange 3 that communicates between the inside of a pipeline 5 and the inside of piston housing 11. Referring also to FIG. 3A, the detector is anchored to the flange 3 by nuts 7. The detector includes an actuator housing 9 rigidily attached to the pressurizeable piston housing 11. A guide channel 13 is threaded to one end of the piston housing 11. The guide channel extends into the interior of the pipeline 5. A translating piston 15 extends over a major portion of the inside of the piston housing 11, and into the guide channel 13. A spring 17 engages the end of the piston 15 distant from the guide channel 13, and urges the piston 15 in the direction toward the pipeline. Fluid seal 19 seals the flange 3 from leakage. A finger-like detector 21 is attached to a cam 23 and located at the end of the guide channel 13 such that the finger 21 extends into the pipeline. The cam 23 is secured by means not shown so that it may rotate about an axis perpendicular to the plane of the cross-section shown in FIG. 3A.

Figure 3B:
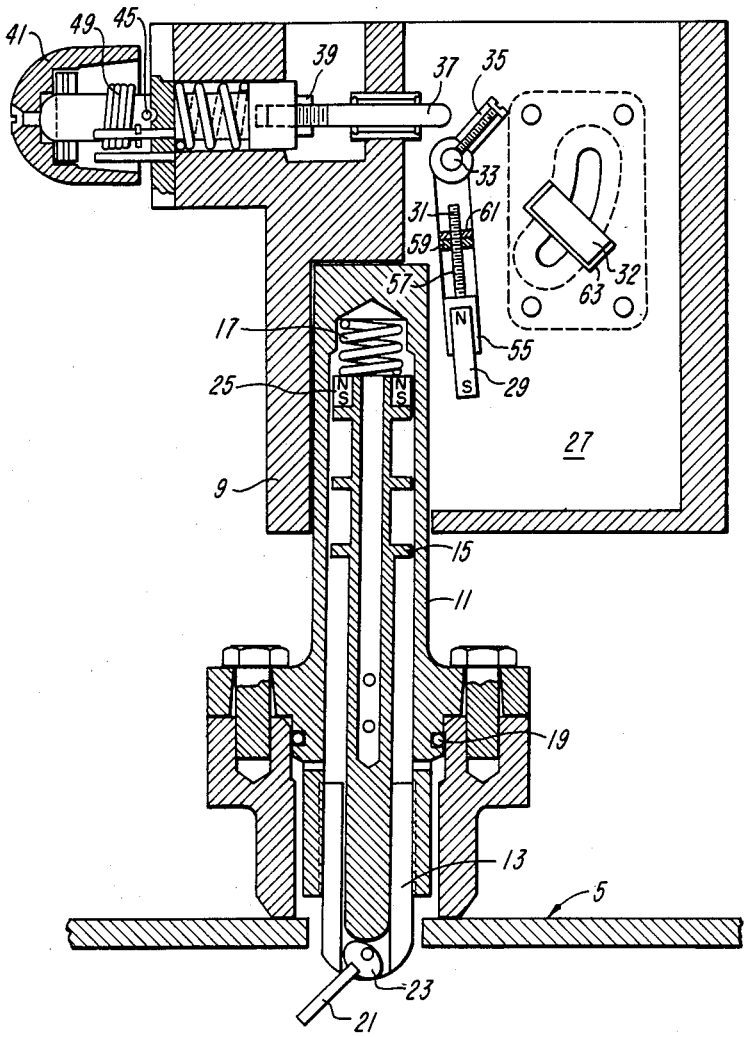
FIG. 3B shows the same cross-sectional view shown in FIG. 3A, during the initial stage of detection of a pig.
Figure 4:
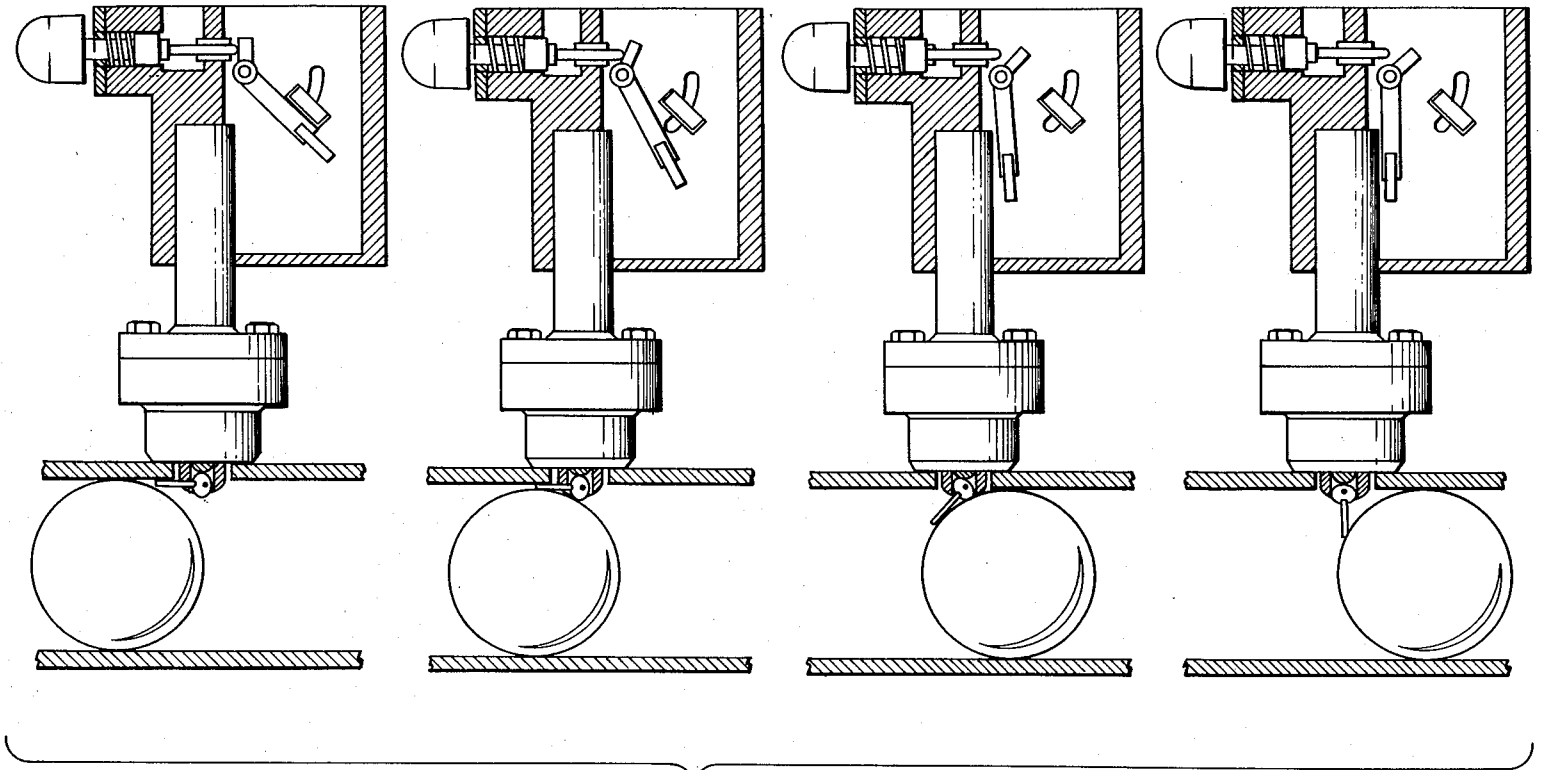
FIG. 4 shows schematically a combination of FIG. 3A through 3C plus an additional intermediate stage also showing the location of a pig or other device to be detected as it passes through a pipeline. The portions of FIG. 4 corresponding to FIGS. 3A, B, and C proceed from right to left respectively. The third figure from the right does not correspond to any of 3A-3C.

Referring now to FIGS. 3B and 4, it can be seen that when a pig engages the finger, forcing it either to the left or right, the cam rotates. Due to the eccentric pivot of the cam, it forces piston 15 upward. A permanent magnet 25 is arranged at the upper end of piston 15, polarized along a line parallel to the line of translation of the piston. Actuator housing 9 has a cavity 27 in which is arranged a hammer magnet 29 and associated linkages, and a booster magnet 32.

In the rest position of the device, in the absence of a pig, the poles of the primary and hammer magnet are arranged so that opposite poles of each magnet are adjacent and therefore the magnets attract each other. For instance, as shown in FIG. 3A, the north pole of the primary magnet 25 is adjacent the south pole of hammer magnet 29. It should be noted, that the hammer magnet need not be positioned such that it is polarized along a line parallel to the line of translation of the piston 15. It need only be positioned such that only the portion of the field generated by one pole of the hammer magnet interracts significantly with the field generated by the primary magnet.

As the piston 15 translates upward, as shown in FIG. 3B due to rotation of cam 23, the magnetic field generated by the primary magnet 25 moves. As it moves, the primary field interracts with the field generated by the hammer magnet 29. While in the state where the primary magnet is at rest, magnets 25 and 29 attract each other, due to the arrangement of the polarities. As the primary magnet translates upward, the interaction of the magnetic fields change such that the magnets repel each other. Primary magnet 25 is constrained by piston 15 so that it may not move in opposition to the magnetic force. Hammer magnet 29 is attached through a swingable attractor bracket 31 to a pivot bearing 33. The attractor bracket 31 is made of a magnetic material. Thus, the attractor bracket 31 and hammer magnet 29 are free to swing away from primary magnet 25 under the influence of the repelling magnetic forces.

Figure 3C:
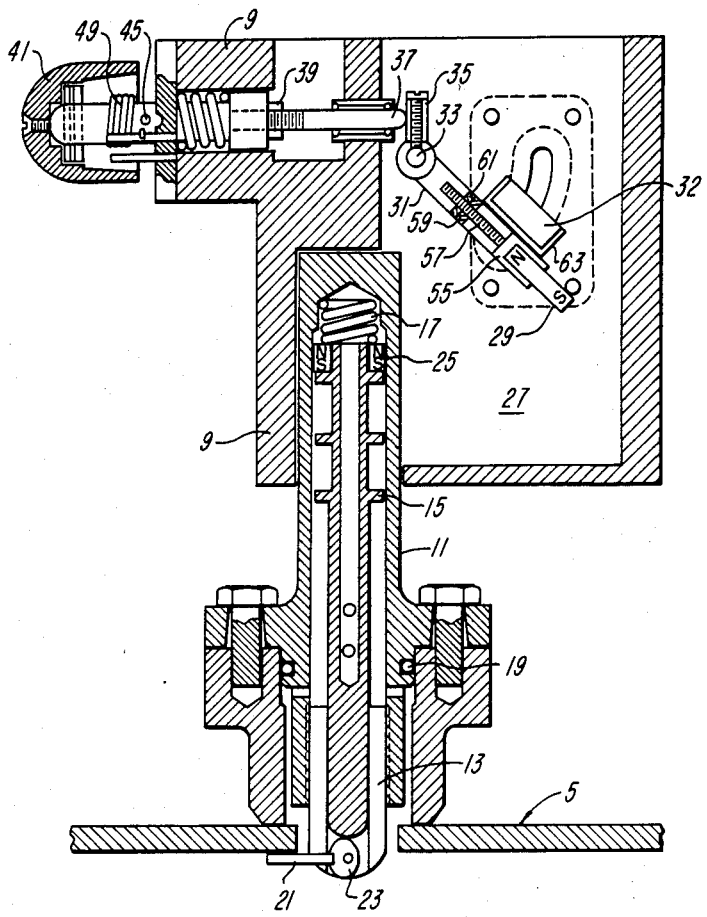
FIG. 3C shows the same view of the embodiment shown in cross-section in FIG. 3A after the final stage of detecting the presence of a pig.

Referring now to FIG. 3C, displacement of the hammer magnet 29 from its rest position, brings the attractor bracket 31 into a position relative to the booster magnet 32, such that the booster magnet attracts the attractor bracket toward the booster magnet. The booster magnet is located such that when the attractor bracket moves toward the booster magnet, a hammer 35, coupled to the supporting attractor bracket 31, swings and comes into contact with a firing pin 37.

Figure 2:
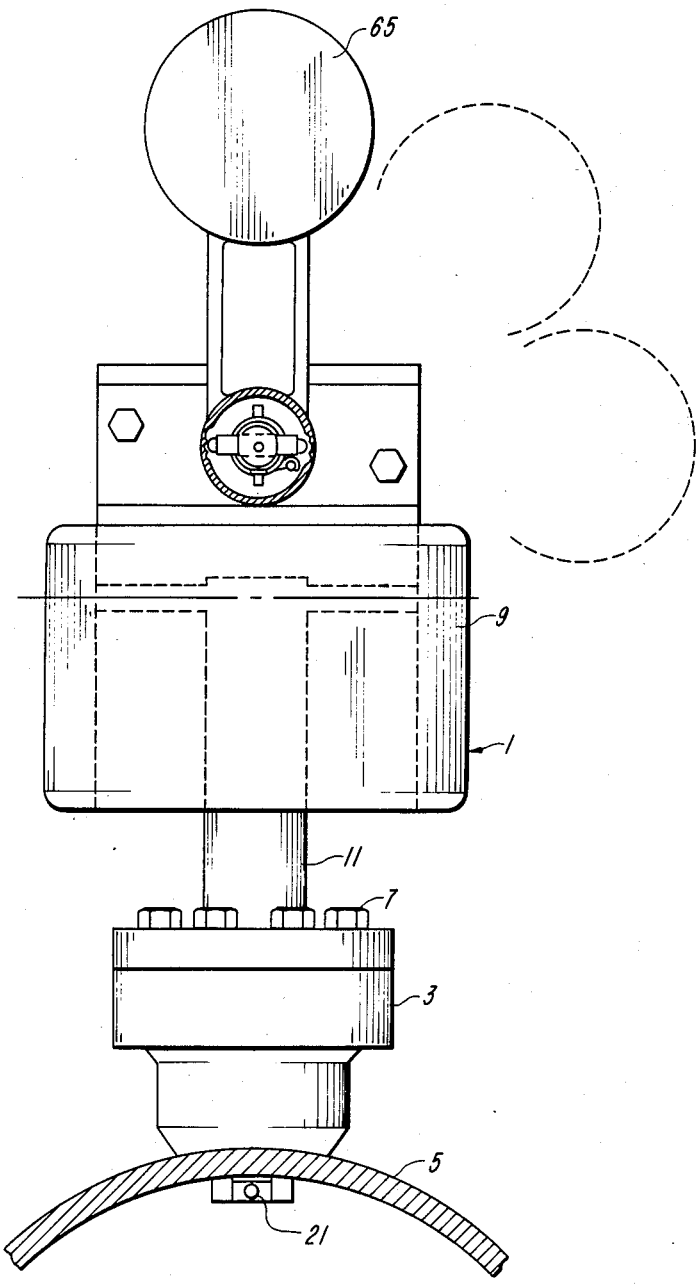
FIG. 2 is a schematic representation of the pig detector of FIG. 1, indicating that a pig has been detected, showing transitional positions of the flag in phantom.
Figure 5:
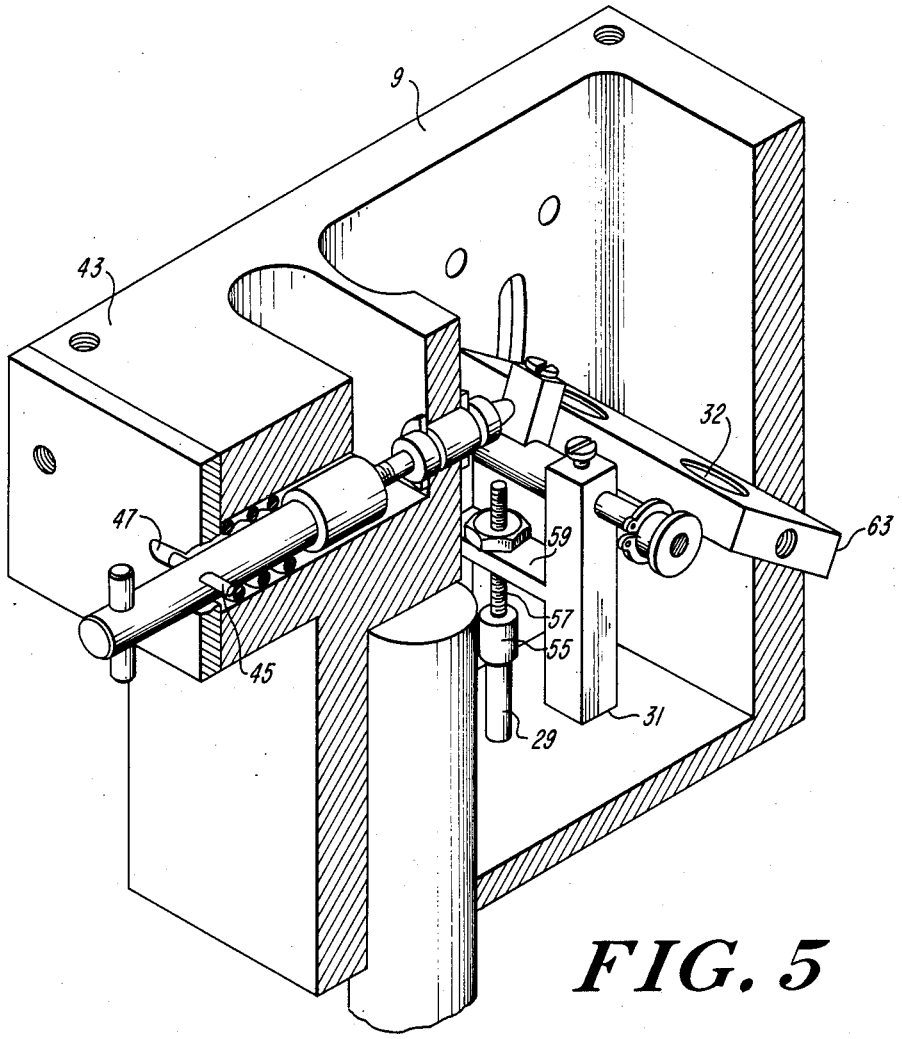
FIG. 5 is an isometric view of a portion of the invention showing the hammer and booster permanent magnets and the mechanism for releasing the mechanical flag, at a stage when no pig has been detected.

The firing pin is connected through a suitable mechanical linkage to a flag or other visually perceptible signaling means. In this case, the firing pin 37 is connected to shaft 39, which is connected to flag support 41. As can best be seen by reference to FIG. 5, shaft 39 is journaled in actuator housing 9. Lock pin 45 engages slot 47 in actuator housing 9. Turning now to FIG. 3C, it is seen that torsion spring 49 is attached to shaft 39 at pin 51 and to actuator housing 9 through pin 53. When plunger 37 forces shaft 39 outward from actuator housing 9, pin 45 emerges from slot 47. Prior to emergence, pin 45 had maintained shaft 39 in a stationary position. After pin 45 has emerged from the slot, torsion spring 49 forces shaft 39 to rotate. Upon rotation, a flag 65 or other signaling device, shown in FIGS. 1 and 2, attached to shaft 39, moves into a conspicuous position. Thus, the device signals the passage of a pig or other obstruction through the shaft.

Returning now to FIGS. 3B and 5, the support structure for the hammer magnet will be described. A non-magnetic clamping device 55 clamps the hammer 29 to a threaded shaft 57. The threaded shaft 57 engages a web portion 59 of attractor bracket 31. A locking nut 61 locks the threaded shaft to a particular position with respect to attractor bracket 31. Thus, the vertical position of the hammer magnet 29 and thus the sensitivity of the device may be adjusted by threading the shaft 57 upward or downward through the web portion of attractor bracket 31.

The booster magnet 32 is contained in a non-magnetic holding box 63 so that it may be attached to the housing 9. This box also prevents sparking and damage to the booster magnet from the impact of the moving attractor bracket 31.

The preceding discussion should be taken as illustrative and not limiting by any means. Variations will be readily apparent to those skilled in the art. For instance, the hammer magnet may be supported in a channel, rather than at one end of a pendulum type arrangement. In that case, the hammer may be attached directly to the portion of the hammer magnet which translates. Secondly, the hammer magnet may be polarized along a line either parallel to its motion or perpendicular to its motion. The only requirement is that it responds to a change in location of the primary magnet by moving toward the booster magnet. Thus, the hammer magnet may be arranged so that attracting poles of the hammer magnet and the booster magnet are brought into an interacting relationship.

The visually perceptible signal means may be any sort of means actuated by a mechanical translation, for instance, merely a colored bar or a simple dial indicator. Further, the translation of the hammer may be used to actuate an electronic signaling device, however this would limit somewhat the advantage of the device that the device not require any electrical power source. Alternatively, in addition to the mechanical and magnetic triggering scheme described, a magnetic reed switch may also be used to provide a redundant failsafe feature, and to provide an electric signaling means for distant transmission or automatic record keeping. Finally, rather than detecting the presence of a pig in a pipeline, the device could be used as a pressure or temperature limit switch, where pressure or temperature exceeding the limit would move the piston to a position where the hammer magnet would swing away.

It should be noted that the primary feature of the invention is that no mechanical portion of the signaling means extends from a portion of the device in fluid communication with the pipeline to an external portion of the device. Therefore, there is no risk of leakage from the pipeline.

Having thus decribed our invention we claim:

1. An apparatus for indicating detection of passage of a pig through fluid in a pipeline comprising:
   (a) a detector housing capable of being pressurized and in communication with said fluid, comprising;
      i. mechanical means for detecting passage of said pig, movable by said pig;
      ii. translatable primary permanent magnet translatable from a rest position to a detection position;
      iii. linkage means for coupling movement of said mechanical detecting means to translation of said primary permanent magnet; and
   (b) an actuator housing adjacent said detector housing comprising;
      i. a booster permanent magnet;
      ii. a hammer permanent magnet translatable from a rest position by said primary magnet and to an actuation position by said booster magnet;
      iii. a translatable hammer, translatable from a rest position to an actuation position by said hammer magnet and said booster permanent magnet;
   (c) visually perceptible signal means for signalling detection of passage of a pig, movable from a rest position to a signalling position; and
   (d) trigger means for moving said visually perceptible signal means, said trigger means triggered by said hammer.

2. The indicating apparatus of claim 1 wherein said linkage means comprises a piston.

3. The indicating apparatus of claim 2 further comprising a pendulum-supported brace, said brace supporting said hammer magnet and coupling said hammer magnet with said hammer.

4. The indicating apparatus of claim 3 wherein said pendulum brace is a magnetic material and said hammer magnet is translatable by said booster magnet by attraction between said booster magnet and said pendulum brace.

5. The indicating apparatus of claim 1 wherein said primary permanent magnet is polarized along the path of translation from said rest position to said detection position.

6. Apparatus for indicating detection of an obstruction in fluid traveling through a pipeline, attachable to a flanged collar that communicates with the inside of a pipeline, comprising:
   a. a pressurizeable piston housing capable of being pressurized and having:
      (i) a substantially cylindrical hollow body closed at one end, and open at the other end, having cylindrical channel extending from said open end to said closed end;
      (ii) a flange shaped to mate in a fluid sealing relation with said flanged pipeline collar;
      (iii) a piston capable of being slid from a rest position toward said closed end to a detection position, said piston disposed within said channel, said piston having a detector end and a magnet end;
      (iv) spring means placed between said piston and said piston housing, said spring means urging said piston toward said open cylindrical end;
      (v) means for detecting passage of an obstruction through said pipeline, said means for detecting passage urging said piston from said rest position to said detection position upon passage of an obstruction; and
      (vi) primary permanent magnet means rigidly attached to said piston at said magnet end and translatable with said piston from a rest position to a detection position, said permanent magnet means being polarized along the axis of motion of the piston, generating a primary magnetic field changeable from a rest state to a detection state; and
   b. an actuator housing having:
      (i) a booster permanent magnet means fixedly, attached to said actuator housing;
      (ii) a hammer permanent magnet means translatable from a rest position to an intermediate position by translation of said primary permanent magnet means from said rest position to said detection position and from said intermediate position to an actuating position by said booster magnet;
      (iii) means for swingably supporting said hammer permanent magnet means in said rest position, said supporting means constraining said hammer permanent magnet means to translate along an arcuate path between said rest position and said detection position;
      (iv) a hammer, attached to said hammer magnet support, said hammer movable from a rest position to an impact position by translation of said hammer magnet means from said rest position to said actuating position; and
      (v) a signal linkage including:
         1. a longitudinally movable firing pin, journaled in said actuator housing movable by impact of said hammer at said activating position and;

2. visually perceptible signal means movable from a first position to a second visable position by longitudinal translation of said firing pin.

7. An apparatus for indicating detection of a change of state of fluid in a pipeline for fluid passage comprising:

(a) a detector housing capable of being pressurized and in communication with said fluid, comprising;
   i. movable mechanical means for detecting said change of state, movable as a result of said change of state;
   ii. translatable primary permanent magnet means translatable from a rest position to a detection position;
   iii. linkage means for coupling movement of said mechanical detecting means to translation of said primary permanent magent; and (b) an actuator housing adjacent said detector housing comprising;
   i. a booster permanent magnet;
   ii. a hammer permanent magnet translatable from a rest position by said primary magnet and to an actuation position by said booster magnet; and
   iii. a translatable hammer, translatable from a rest position to an acutation position by said hammer magnet;

(c) visually perceptible signal means for signallingg detection of a change of state, movable from a rest position to a signalling position; and (d) trigger means for moving said visually perceptible signal means, said trigger means triggered by said hammer.

* * * * *